US007445461B1

(12) United States Patent
Polnyi

(10) Patent No.: US 7,445,461 B1
(45) Date of Patent: Nov. 4, 2008

(54) COMPOSITE ELECTRICAL CONTACT WITH ELASTIC WIRE CONTACT PART AND SEPARATE RIGID PART

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,486

(22) Filed: Jan. 18, 2008

(51) Int. Cl.
*H01R 12/00* (2006.01)

(52) U.S. Cl. ..... 439/66

(58) Field of Classification Search ..... 439/66, 439/83, 591, 862
See application file for complete search history.

(56) References Cited

U.S. PATENT DOCUMENTS 6,908,347 B2 * 6/2005 Sasaki ..... 439/824
7,201,584 B1 * 4/2007 Ju et al. ..... 439/71
7,335,068 B2 * 2/2008 Dwan et al. ..... 439/700
2002/0081870 A1 * 6/2002 Toda ..... 439/66
2004/0253847 A1 * 12/2004 Ma ..... 439/66
2005/0059270 A1 * 3/2005 Zheng et al. ..... 439/66

* cited by examiner

*Primary Examiner*—Tho D Ta
(74) *Attorney, Agent, or Firm*—Wei Te Chung

(57) ABSTRACT

A composite electrical contact (1) comprises an elastic wire contact part (20) for electrically connected to the CPU (40) and a separate rigid part (10) for electrically connected to the PCB (50). The elastic wire contact part (20) defines a body portion (21) and a spring arm (22) extending upwardly from the upper end of the body portion (21), the end of the spring arm (22) defines a mating portion (222) for electrically connected to the CPU (40). The separate rigid part (10) defines a base portion (11) connected with the body portion (21) of the elastic wire contact part (20) and a soldering paddle (13) extending downwardly from the lower end of the base portion (11) for electrically connected to the PCB (50). The CPU (40) connects with only the elastic wire contact part (20) and the PCB (50) connects with only the separate rigid part (10) to make a good electrical connection between the CPU (40) and the PCB (50). The separate rigid part (10) can share the force that the CPU (40) exerted on the elastic wire contact part (20), which avoids the elastic wire contact part (20) deformed excessively.

15 Claims, 6 Drawing Sheets

COMPOSITE ELECTRICAL CONTACT WITH ELASTIC WIRE CONTACT PART AND SEPARATE RIGID PART

BACKGROUND OF THE INVENTION

1. Field of the Invention

The present invention relates to an electrical contact, and particularly to a composite electrical contact with separate rigid part and elastic wire contact part connected with the separate rigid part for electrically connecting an electronic package, such as a central processing unit (CPU), with a circuit substrate, such as a printed circuit board (PCB).

2. Description of the Prior Art

FIG. 6 discloses an electrical connector for electrically connecting an electronic package, such as a central processing unit (CPU) (not shown), with a circuit substrate, such as a printed circuit board (PCB) (not shown), comprises an insulative housing 1' and a wire contact 2' fixed in the housing 1' with an insert molding method. The wire contact 2' defines an upper mating portion 21' extending beyond an upper surface of the insulative housing 1' for connecting with the CPU and a bottom portion 22' extending beyond a bottom surface of the insulative housing 1' for connecting with the PCB. When the CPU exerts a downward force to the contact 2', the mating portion 21' is deformed accordingly, so as to provide a good connection between the CPU and the contact.

However, the elasticity of the mating portion is poor, the force that the CPU exerted on it may make it to be deformed permanently, thus affecting the quality of the whole connector.

In view of the above, a new electrical contact that overcomes the above-mentioned disadvantages is desired.

SUMMARY OF THE INVENTION

Accordingly, the object of the present invention is to provide a composite electrical contact which can provide good elastic deformation when pressed.

To fulfill the above-mentioned object, the present invention provides a composite electrical contact for connecting a CPU with a PCB, comprising an elastic wire contact part for electrically connected to the CPU and a separate rigid part for electrically connected to the PCB. The elastic wire contact part defines a body portion and a spring arm extending upwardly from the upper end of the body portion, the end of the spring arm defines a mating portion for electrically connected to the CPU. The separate rigid part defines a base portion connected with the body portion of the elastic wire contact part and a soldering paddle extending downwardly from the lower end of the base portion for electrically connected to the PCB. The CPU connects with only the mating portion of the elastic wire contact part and the PCB connects with only the soldering paddle of the separate rigid part to make a good electronic connection between the CPU and the PCB. The separate rigid part can share the force that the CPU exerted on the elastic wire contact part, which avoids the elastic wire contact part deformed excessively.

Other objects, advantages and novel features of the invention will become more apparent from the following detailed description when taken in conjunction with the accompany drawings.

DETAILED DESCRIPTION OF THE PREFERRED EMBODIMENT OF THE INVENTION

Reference will now be made to the drawings to describe the present invention in detail.

Figure 1:
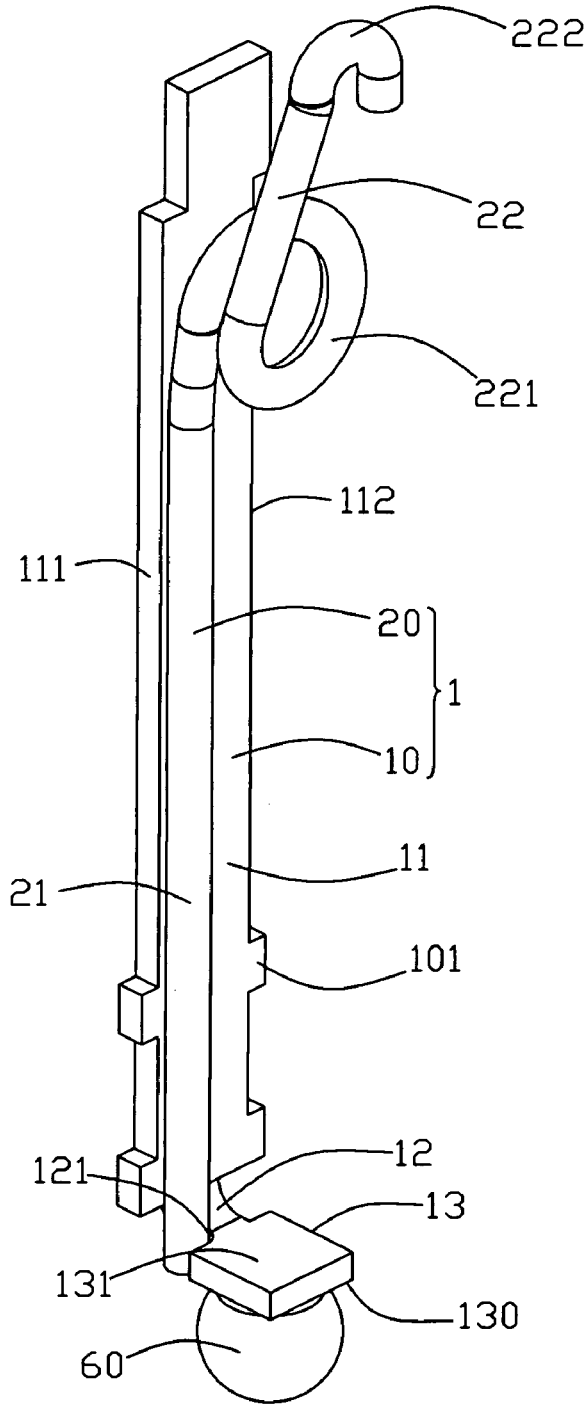
FIG. 1 is an isometric view of the composite electrical contact in accordance with the first embodiment of the present invention.
Figure 2:
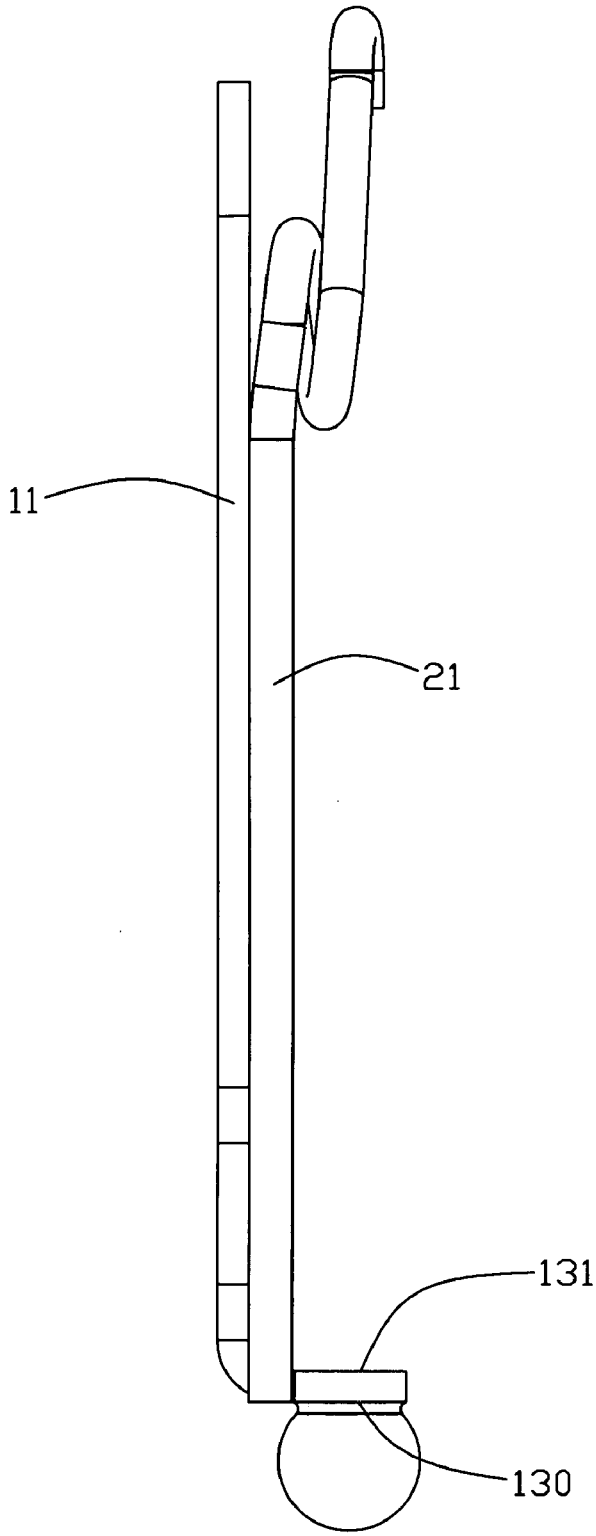
FIG. 2 is a side elevation view of the composite electrical contact shown in FIG. 1.

Referring to FIGS. 1-2, a composite electrical contact 1 in accordance with the first embodiment of the preferred present invention, comprises an elastic wire-shape contact part 20 and a separate rigid connecting part 10. The separate rigid connecting part 10 is of a substantially L-shape viewed from side elevation and defines a flat base portion 11 located in a vertical plane, a curved connecting portion 12 extending downwardly and curvedly from the lower end of the base portion 11 and a rectangular board-shape soldering paddle 13 extending forwardly and flatly from the connecting portion 12. The connecting portion 12 and the solder paddle 13 together form a J-shape and since the width of the connecting portion 12 is smaller than that of the solder paddle 13, thus, a pair of cutouts 121 is formed. The soldering paddle 13 defines a bottom surface 130 for soldered to the soldering ball 60 and an upper surface 131 relative to the bottom surface 130. The base portion 11 with less elasticity is stamped of a relatively cheaper metal sheet and defines a plurality of barbs 101. The elastic wire-shape contact part 20 is made from relatively expensive high strength and temper copper alloy with a circular shape and higher elasticity and comprises a straight body portion 21 connected to the base portion 11 of the separate rigid part 10 and a spring arm 22 extending from the upper end of the body portion 21. In this embodiment of the present invention, the body portion 21 of the elastic wire contact part 20 is welded to the base portion 11 of the separate rigid part 10 at two upper and lower points thereof. Thus, when there is a downward force exerts on the spring arm 22, the deflection of the spring arm 22 is little, so the wiping length is reduced. The spring arm 22 comprises a loop portion 221 and a curved mating portion 222 at the end of the spring arm 22. In this embodiment, the mating portion 222 is curved downwardly facing to the first side edge 112 to form a substantially U-shape with curved section served as mating surface, also it can be curved downwardly facing to the second side edge 111.

Referring to FIG. 2, The bottom free end of the body portion 21 is received in one cutout 121 and contacts with side edges of the connecting portion 12 and the soldering paddle 13. At the same time, the bottom free end of the body portion 21 is between the upper surface 131 and the bottom surface 130 of the soldering paddle 13 and is flush with the bottom surface 130. When the soldering paddle 13 is soldered to the soldering ball 60, the body portion 21 is soldered with the soldering paddle 13 and the connecting portion 12 at the same time during the reflow of the melted soldering ball 60.

Figure 3:
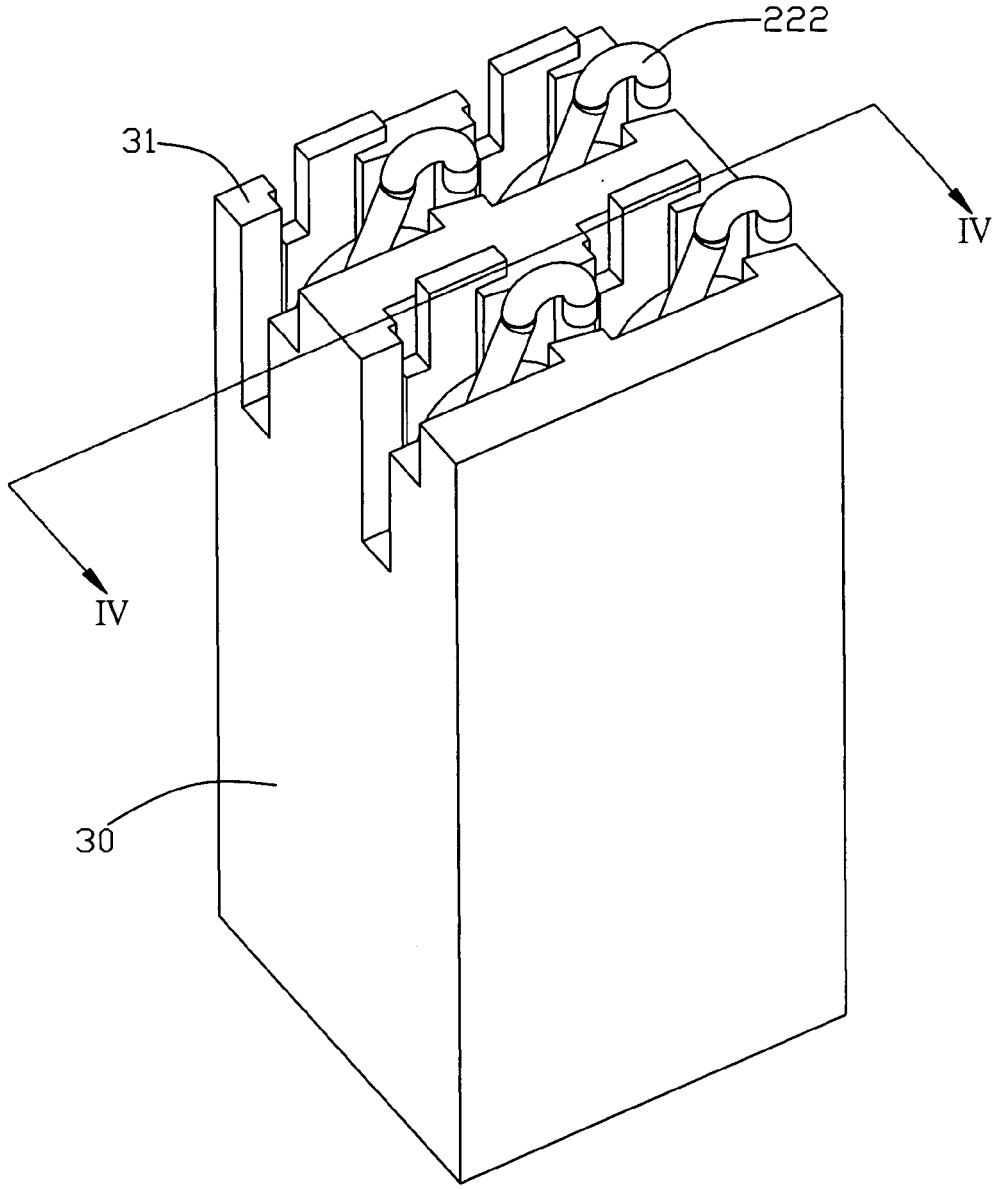
FIG. 3 is an isometric view of a number of the composite electrical contacts assembled to part of the insulative housing.
Figure 4:
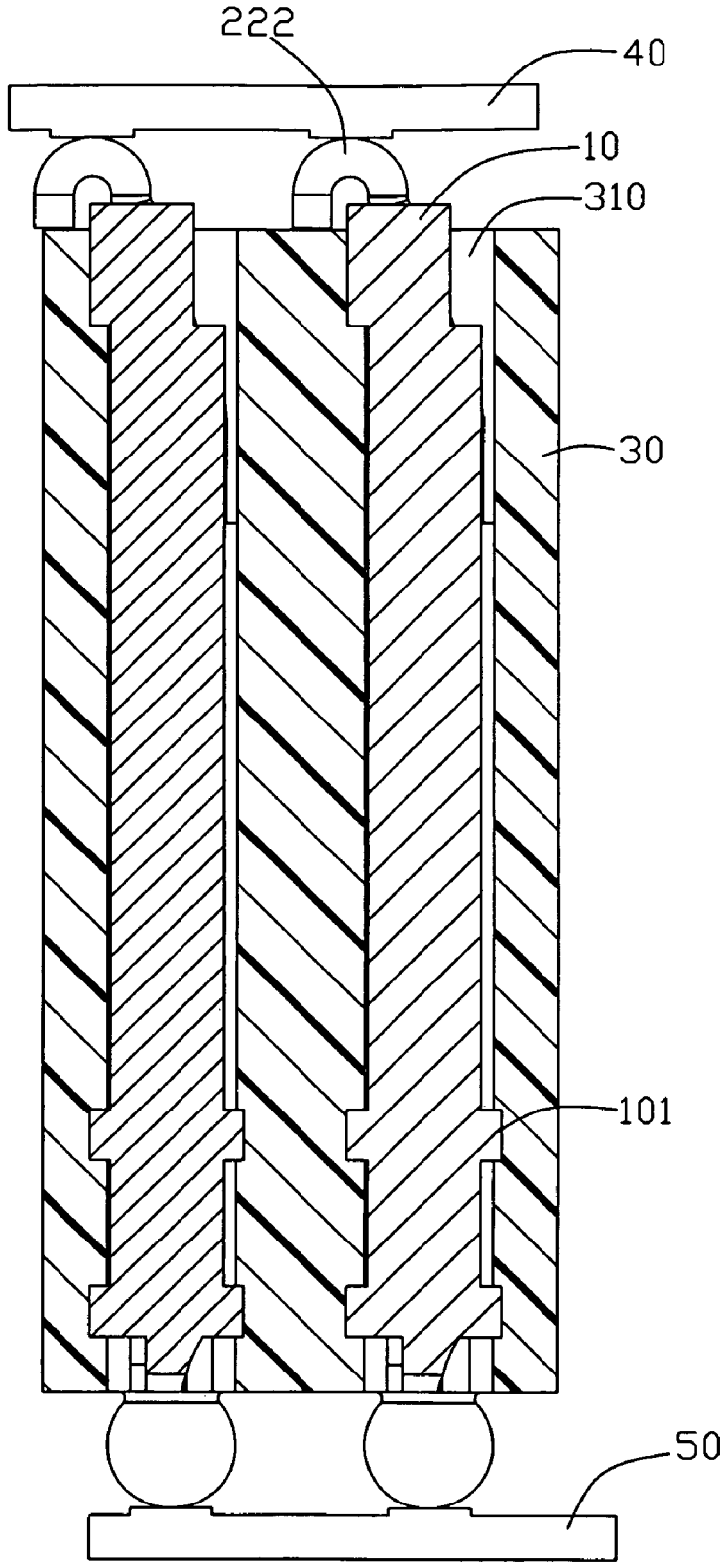
FIG. 4 is a schematic, cross-sectional view of FIG. 3, taken along line IV-IV.

FIGS. 3-4 show the composite electrical contact 1 assembled to the insulative housing 30 (only shown part of the insulative housing 30 in FIGS. 3-4). The insulative housing 30 defines an upper mating surface 31 for the CPU 40, opposite lower mounting surface 32 for being assembled to the PCB 50 and multiplicity of passageways 310 there through for receiving the composite electrical contacts 1. The mating portion 222 of the elastic wire contact part 20 extends beyond the mating surface 31 for electrically connects to the CPU 40. The separate rigid part 10 is positioned steadily in the passageways 310 due to the barbs 101 engage with the sidewalls of the passageways 310 interferentially, thus the composite electrical contact 1 can also be positioned steadily in the insulative housing 30.

Figure 5:
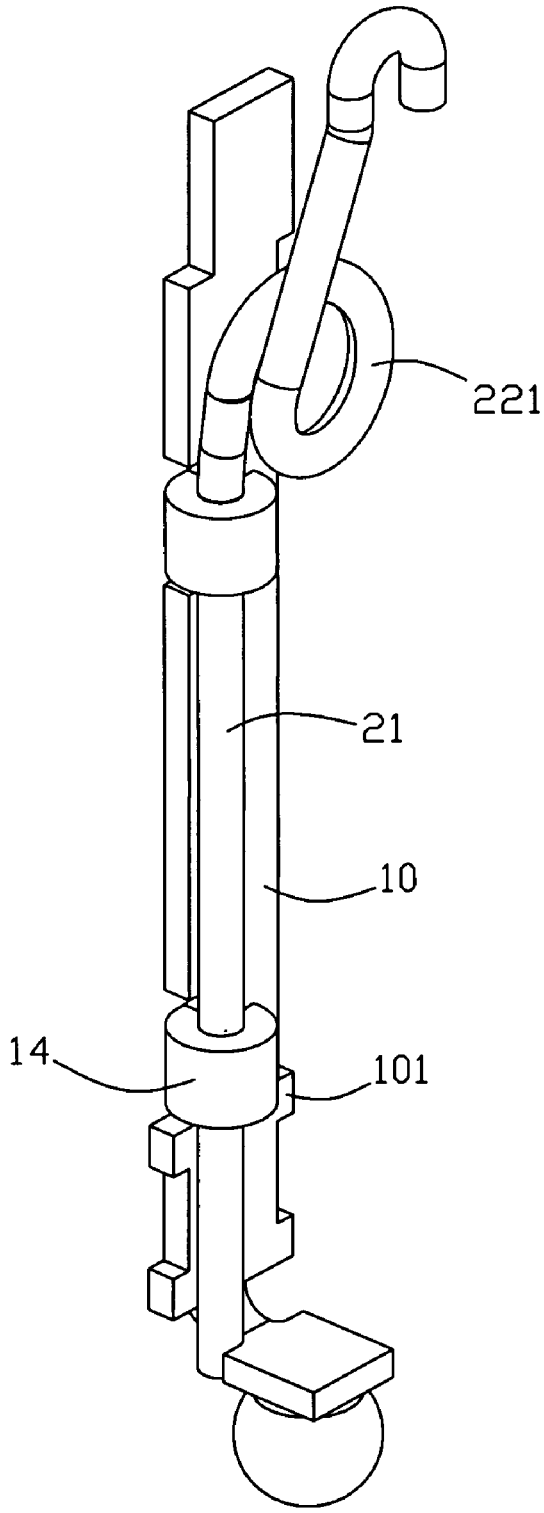
FIG. 5 is an isometric view of the composite electrical contact in accordance with the second embodiment of the present invention.
Figure 6:
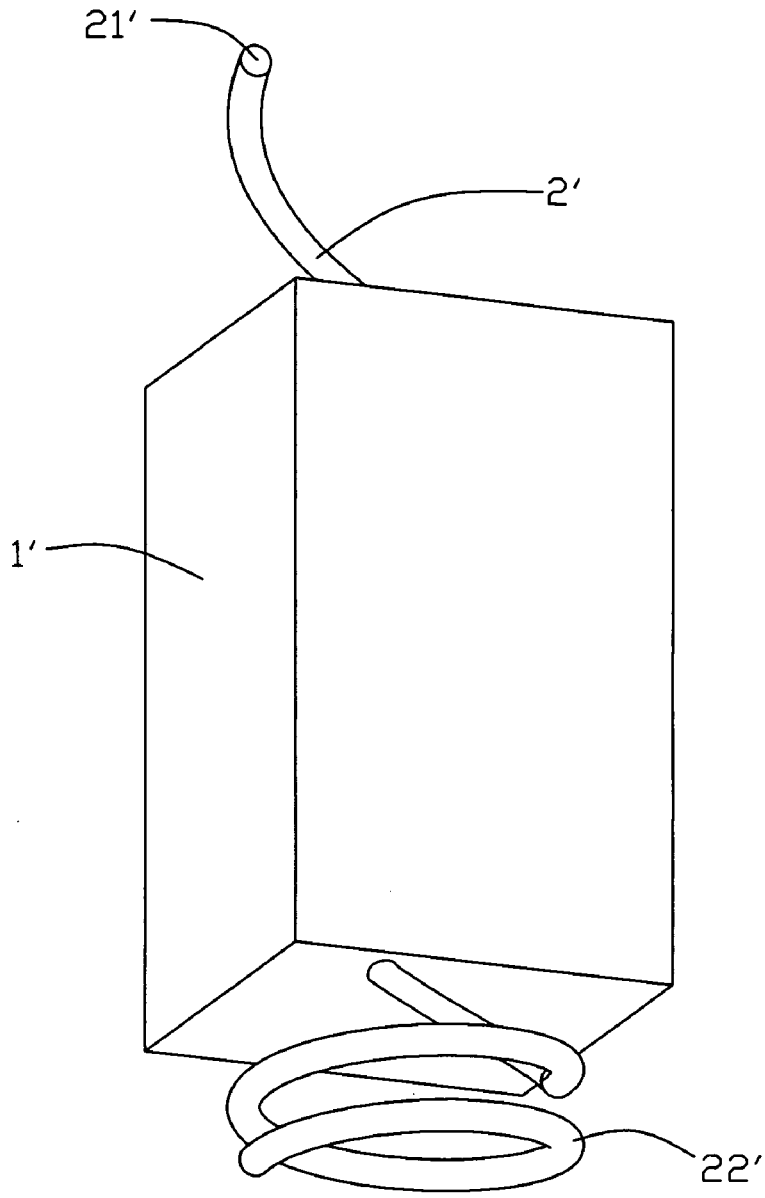
FIG. 6 (PRIOR ART)
FIG. 6 is an isometric view of part of a conventional connector.

FIG. 5 shows the second embodiment of the preferred composite electrical contact 1, Compared with the first embodiment of the preferred composite electrical contact 1, the difference is the base portion 11 forms two crimping members 14 curved from one side edge thereof for secured receiving the body portion 21 of the elastic wire contact part 20, through this method, the elastic wire contact part 20 can also be positioned to the separate rigid part 10 steadily. In the second embodiment, the pair of crimping members 14 is formed adjacent to the loop portion 221 and the barbs 101, respectively. However, it is to be pointed out that the number and the position of the crimping members 14 is not definite, it can be changed according to the requirement.

In the above detailed description, when the CPU 40 engages with the mating portions 222 of the composite electrical contacts 1, the CPU only connects with the mating portions 222 of the elastic wire contact parts 20 and can not touch the separate rigid part 10, at the same time, the PCB 50 connects only with the separate rigid part 10 through the soldering balls 60 and can not tough the elastic wire contact part 20, through this way, make a good connection between the CPU 40 and the PCB 50, because the body portion 21 of the elastic wire contact part 20 is welded to the base portion 11 of the separate rigid part 10 at two upper and lower points thereof, so when there is a downward force exerts on the spring arm 22, the deflection of the spring arm 22 is little, so the wiping length is reduced. At the same time, the base portion 11 with less elasticity is stamped of a relatively cheaper metal sheet, which makes a cost down of the composite contact 1.

It is to be understood, even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A composite electrical contact for connecting an electronic package with a circuit substrate, comprising:

an elastic wire contact part adapted for electrically connected to the electronic package, having a body portion and an elastic spring arm extending upwardly from one end of the body portion for electrically connected to the electronic package; and a separate rigid part adapted for electrically connected to the circuit substrate, having a base portion and a soldering paddle extending downwardly from the lower end of the base portion for electrically connected to the circuit substrate; wherein said body portion of the wire contact part connected with said base portion of the separate rigid part for securely fastened to the base portion, the electronic package connects with only the elastic spring arm and the circuit substrate connects with only the soldering paddle for connecting the electronic package with the circuit substrate;

wherein the soldering paddle defines a bottom surface for soldered to the circuit substrate and an upper surface relative to the bottom surface, a bottom end of the body portion located between the upper surface and the bottom surface;

wherein the bottom end of the body portion is flush with the bottom surface.

2. The composite electrical contact as claimed in claim 1, wherein the body portion of the elastic wire contact part at two upper and lower points thereof are welded to the base portion of the separate rigid part, when there is a downward force exerts on the spring arm, the deflection range of the spring arm is reduced.

3. The composite electrical contact as claimed in claim 1, wherein the base portion of the separate rigid part is formed from a metal sheet and forms at least one crimping member crimping the body portion of the elastic wire contact part.

4. The composite electrical contact as claimed in claim 1, wherein the spring arm comprises a loop portion connected with the body portion and a curved mating portion at the end of the spring arm.

5. The composite electrical contact as claimed in claim 4, wherein the base defines a first side wall and a relative second side wall, the mating portion is curved downwardly facing to the second side wall to form a substantially U-shape with curved section served as mating surface.

6. The composite electrical contact as claimed in claim 5, wherein the mating portion curved downwardly facing to the first side wall to form a substantially U-shape with curved section served as mating surface.

7. The composite electrical contact as claimed in claim 1, wherein the base portion of the separate rigid part is formed from a metal sheet and defines a plurality of barbs.

8. The composite electrical contact as claimed in claim 7, wherein a curved connecting portion extends downwardly from the lower end of the base portion to connect the soldering paddle with the base portion.

9. The composite electrical contact as claimed in claim 8, wherein the connecting portion and the solder paddle together form a pair of cutouts, the lower end of the body portion is positioned in one of the cutouts.

10. The composite electrical contact as claimed in claim 9, wherein the lower end of the body portion is welded to the connecting portion and the soldering paddle when the soldering paddle soldered to the circuit substrate.

11. An electrical connector for connecting an electronic package with a circuit substrate, comprising:

an insulative housing defining a multiplicity of passageways therethrough along up-to-down direction; and a plurality of composite electrical contacts received in the passageways respectively, each composite electrical contact comprising an elastic wire contact part having a body portion and a mating portion extending upwardly beyond the insulative housing from the upper end of the body portion for electrically connected to the electronic package; and a separate rigid part having a base portion and a soldering paddle extending downwardly from the lower end of the base portion for electrically connected to the circuit substrate; wherein said body portion is connected with said base portion for securely fastened to the base portion, the electronic package connected with only the mating portion and the circuit substrate connected with only the soldering paddle for connecting the electronic package with the circuit substrate, wherein the soldering paddle defines a bottom surface for soldered to the circuit substrate and an upper surface relative to the bottom surface, a bottom end of the body portion located between the upper surface and the bottom surface;

wherein the bottom end of the body portion is flush with the bottom surface.

12. The composite electrical contact as claimed in claim 11, wherein the body portion of the elastic wire contact part is welded to the base portion of the separate rigid part.

13. The composite electrical contact as claimed in claim 11, wherein the base portion of the separate rigid part defines a crimping member for locating the body portion of the elastic wire contact part.

14. The composite electrical contact as claimed in claim 11, wherein the base portion of the separate rigid part is formed from a metal sheet and defines a plurality of barbs interferentially engaged with the housing.

15. An electrical connector comprising:

an insulative housing defining a mating face and a mounting face;

a plurality of contact units disposed in the housing and spaced from each other, each of said contact units including a separate main part having a retention section to retain the contact unit in the housing, and a solder portion exposed to the mounting face for mounting to a printed circuit board, and a subordinate part attached to the separate main part instead of to the housing and defining a mating portion upwardly extending above the mating face for mating with an electronic component; wherein the subordinate part has superior resiliency in comparison with said separate main part;

wherein said housing defines a plurality of passageways each receiving one corresponding contact unit, and the separate main part is essentially located on one peripheral side in the passageway.

* * * * *